US009476151B2

(12) United States Patent
Bagley

(10) Patent No.: US 9,476,151 B2
(45) Date of Patent: Oct. 25, 2016

(54) HOOP FRAME AND ZONE TO ZONE METHOD FOR QUILTING

(71) Applicant: Jim Matthews Bagley, West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 524 days.

(21) Appl. No.: 14/063,021

(22) Filed: Oct. 25, 2013

(65) Prior Publication Data

US 2015/0114272 A1 Apr. 30, 2015

(51) Int. Cl.
*D05B 39/00* (2006.01)

(52) U.S. Cl.
CPC ..... *D05B 39/005* (2013.01)

(58) Field of Classification Search
CPC .... D04B 11/00; D04B 39/005; D04B 39/00; D04B 91/10; D04B 91/06; D05C 9/04
See application file for complete search history.

(56) References Cited

U.S. PATENT DOCUMENTS

| | | | | |
|---|---|---|---|---|
| 4,192,241 | A | 3/1980 | Reed et al. | |
| 4,411,208 | A | 10/1983 | Nishida et al. | |
| 4,834,006 | A | 5/1989 | Goto | |
| 4,969,410 | A | 11/1990 | Brower et al. | |
| 5,018,460 | A | 5/1991 | Schilling et al. | |
| 5,040,473 | A * | 8/1991 | Zesch | D05B 11/00 112/117 |
| 5,287,820 | A | 2/1994 | Stutznacker | |
| 5,540,165 | A * | 7/1996 | Katou | D05B 69/02 112/259 |
| 5,860,375 | A | 1/1999 | Williams | |
| 5,913,275 | A | 6/1999 | Flynn | |
| 6,079,341 | A * | 6/2000 | Resta | D05B 11/00 112/117 |
| 6,615,756 | B2 | 9/2003 | Barrus | |
| 6,792,884 | B1 | 9/2004 | Barrus | |
| 6,860,211 | B2 * | 3/2005 | Valeriote | D05B 11/00 112/117 |
| 6,883,446 | B2 | 4/2005 | Koerner | |
| 6,990,914 | B2 | 1/2006 | Canan | |
| 7,011,031 | B1 | 3/2006 | Bradley | |
| 7,207,281 | B1 * | 4/2007 | Kasa | D05B 11/00 112/117 |
| 7,584,709 | B2 | 9/2009 | Nakatsu et al. | |
| 9,145,630 | B2 * | 9/2015 | McCoy | D05B 11/00 |
| 2003/0200906 | A1 * | 10/2003 | Maag | D05B 11/00 112/117 |
| 2012/0318181 | A1 | 12/2012 | Kasa | |

* cited by examiner

*Primary Examiner* — Danny Worrell
(74) *Attorney, Agent, or Firm* — J. David Nelson

(57) ABSTRACT

A hoop frame unit having a frame support structure, a hoop frame assembly, and a machine carriage assembly. The hoop frame assembly has a front fabric retainer, a rear fabric retainer, a first end retainer, and a second end retainer. Retainer clips mate with retainer seats on each of the retainers to secure fabric zones of quilt cores in place for machine sewing. The machine carriage assembly is supported by a front carriage track and a rear carriage track which are affixed on opposing ends to the frame support structure. The machine carriage assembly incorporates a lateral carriage element for carriage lateral movement, and a pair of longitudinal tracks on the lateral carriage element to provide for machine longitudinal movement.

14 Claims, 8 Drawing Sheets

HOOP FRAME AND ZONE TO ZONE METHOD FOR QUILTING

BACKGROUND

The present invention is in the field of devices and methods for machine quilting, and, in particular, in the field of quilting frames and other devices and methods for the positioning and retention of fabric for sewing with a quilting machine.

Devices for machine quilting typically consist of three primary components, a frame, a sewing machine, and a machine carriage having a carriage bottom plate that travels laterally on an x-axis and a carriage top plate that travels longitudinally on a y-axis. Quilt fabric layers, which typically consist of backing fabric, batting, and top fabric, but may consist of as few as one layer of fabric or more than three layers, which single fabric layer, or multiple layers collectively, may be referred to in this application as a "quilt core". The term "fabric layers" when used in this application, shall be defined to include a single layer of fabric. The fabric layers are rolled onto fabric layer rails and fed from the respective fabric layer rails to a take-up rail that passes through the throat of the sewing machine, suspending the fabric layers of the quilt core together to rest on the sewing machine bed. In order for the fabric layers of the quilt core to remain flat and straight, it is necessary for the fabric layer rails and the take-up rail to be longer than the quilt is wide.

For a typical quilting frame, the sewing machine is positioned on and secured to the quilting frame carriage top plate and is guided on the machine carriage to create a desired stitching pattern as the layers of fabric are quilted together. The sewing machine is guided longitudinally and laterally across the available quilting work area, which is determined by the length of the throat of the sewing machine and the width of the quilt fabric itself, the width of the quilt being limited to the width of the quilting frame. When the fabric in the work area has been sewn, the fabric is rolled forward from the fabric layer rails to the take-up rail so that the completed area is rolled onto the take-up rail which passes through the throat of the sewing machine. This also advances the fabric that has not yet been quilted into the work area and the new strip of un-quilted fabric area may then be sewn. A typical quilting frame requires that the quilt be sewed from front to back, or vice versa, with the fabric progressively being fed onto the take-up rail as each strip of the quilt core is sewed from one side of the quilt core to the other.

An alternative to machine quilting with a traditional frame is to quilt by hand, performing all the stitching without a sewing machine, simply using a needle and thread. Another alternative is to baste the three layers of fabric together using pins or small stitches later to be removed. Once the fabric is basted, the user can quilt the layers together by guiding the fabric through the machine by hand. Hoops may also used to hold small areas of the quilt flat and straight to perform the stitching. Embroidery machines, for example, use a hoop to hold the fabric and then through motor control, move the hoop while the sewing machine stitches to create the desired patterns on the fabric.

Quilting without a frame requires basting, which is time consuming. Hand quilting or quilting by using a hoop also requires basting, and moving the fabric to create the sewing patterns can be cumbersome due to the amount of fabric that has to be manipulated in a large quilt. Machine quilting on a frame is a much more convenient and expeditious way to complete a quilt. However, machine quilting on a frame requires a large frame in order to make large quilts. Many quilters do not have enough space to accommodate the large quilting frame.

An objective of the present invention is to provide an apparatus for use in machine quilting that does not incorporate a full width quilting frame.

A further objective of the present invention is to provide an apparatus for use in machine quilting that requires substantially less space than that required by a typical quilting frame.

A further objective of the present invention is to provide an apparatus for use in machine quilting that does not require basting of the fabric layers of the quilt core.

A further objective of the present invention is to provide a fabric retention and positioning apparatus for use in machine quilting that incorporates a hoop frame to hold the quilt core on all four sides of the work area to be quilted, rather than full width fabric layer rails and a full width take-up rail that passes through the throat of the sewing machine.

A further objective of the present invention is to provide an apparatus for machine quilting which incorporates a hoop frame which allows the fabric to drape around the frame instead of rolling from fabric rails onto a take-up rail.

A further objective of the present invention is to provide an apparatus for machine quilting which incorporates a hoop frame that provides for the segmented stitching of a larger size quilt while requiring a much smaller space occupied by the quilting apparatus.

A further objective of the present invention is to provide an apparatus for machine quilting which incorporates a hoop frame for which frame width is no longer a limiting factor in the size of a quilt that can be quilted.

A further objective of the present invention is to provide an apparatus for machine quilting which incorporates a hoop frame and a machine carriage.

SUMMARY OF THE INVENTION

A preferred embodiment of a hoop frame unit of the present invention is comprised of a frame support structure, a hoop frame assembly, and a machine carriage assembly. A preferred embodiment of the hoop frame assembly is comprised of a front fabric retainer, a rear fabric retainer, a first end retainer, and a second end retainer. The machine carriage assembly is supported by a front carriage track and a rear carriage track which are affixed on opposing ends to the frame support structure.

The machine carriage assembly incorporates a lateral carriage element to which carriage rollers, are affixed, which provide for the machine carriage assembly to accomplish carriage lateral movement, and a pair of longitudinal tracks, which provide for a quilting machine with an integral wheeled base, or a separate wheeled machine base to which a quilting machine may removably mounted, to provide for machine longitudinal movement on the longitudinal tracks. Whether the quilting machine itself or the quilting machine mounted on a separate wheeled machine base, is positioned on the longitudinal tracks, the quilting machine is free rolling upon the lateral carriage element, thereby providing for machine longitudinal movement concurrently with the carriage lateral movement provided by the carriage lateral element.

The front fabric retainer has a front retainer seat. The first end retainer has a first end retainer seat and the second end retainer has a second end retainer seat. A front retainer clip may be used to secure fabric to the front fabric retainer by mating with the front retainer seat after the quilt core is draped over the front fabric retainer. Likewise a first end retainer clip and a second end retainer clip may be used to mate respectively with the first end retainer seat and the second end retainer seat after the quilt core is draped over the respective end retainers.

The quilt core may be secured to the rear fabric retainer by draping the quilt core over the rear fabric retainer, and securing the quilt core in place by the rear retainer clip. The fabric loose end of the quilt core advanced into the machine throat may be rolled onto a flexible take-up spool, and, to help keep the fabric layers of the fabric loose end from interfering with the sewing of the fabric zone, the portion of the quilt core positioned between the front fabric retainer, the first end retainer, the second end retainer, and the rear fabric retainer, after the respective retainer clips are secured in place. A front retainer tightening mechanism, a first end retainer tightening mechanism, and a second end retainer tightening mechanism may be used to further tighten the fabric zone as desired for sewing by the quilting machine. The front retainer tightening mechanism, the first end retainer tightening mechanism, and the second end retainer tightening mechanism preferably have a ratchet drive.

When the quilt core is secured and the selected fabric zone is in place, the quilting machine may be operated by the user to sew the desired quilting pattern in the fabric zone. Once the sewing of the fabric zone is completed, the retainer clips are removed from the quilt core and the fabric moved and then re-secured, as desired by the user, presenting another selected fabric zone for sewing by the user. A typical quilting frame requires that the quilt be sewed from front to back, or vice versa, with the fabric progressively being fed onto a take-up rail as each strip of the quilt core is sewed from one side of the quilt core to the other. The hoop frame unit and the hoop frame assembly of the present invention, on the other hand, provide for the quilt core to be re-positioned laterally, longitudinally or diagonally, or to be rotated to any extent desired by the user. When sewing is completed on a fabric zone, the user has complete flexibility to re-position the quilt core as desired for the convenience or preference of the user as the user progresses from one fabric zone to another. The user can sequence the sewing of the fabric zones as desired and can overlap respective fabric zones on any side, in any direction, and to any extent desired.

An optional quilting machine controller with pattern matching software may also be incorporated, which allows the end points of a partially sewed pattern from a sewed fabric zone to be matched with the start points for the continued sewing of the pattern in a successive fabric zone.

DETAILED DESCRIPTION OF PREFERRED EMBODIMENTS

Figure 1:
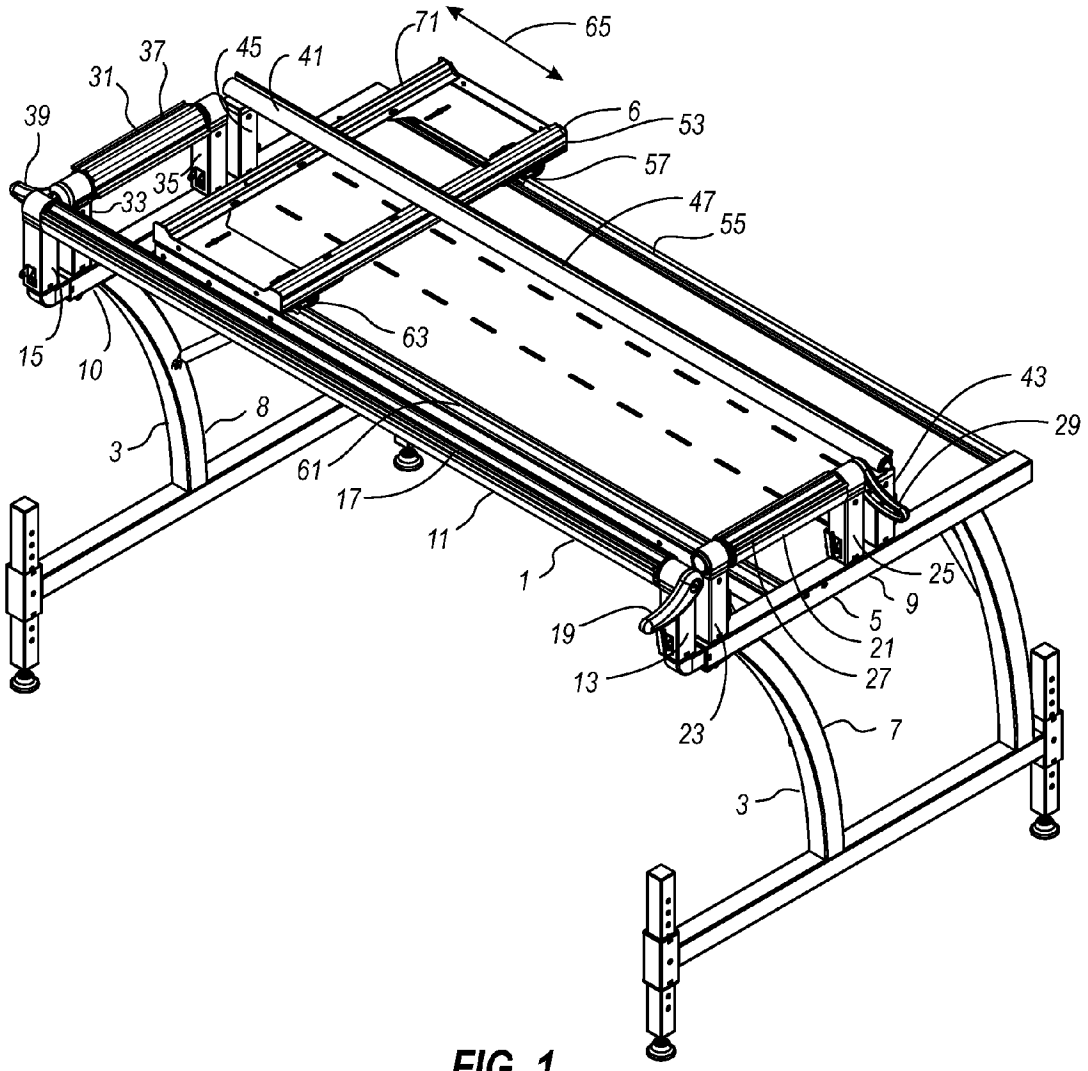
FIG. 1 is a front perspective view of a preferred embodiment of a hoop frame unit, including the frame support structure, hoop frame assembly, and machine carriage assembly, of the present invention.
Figure 2:
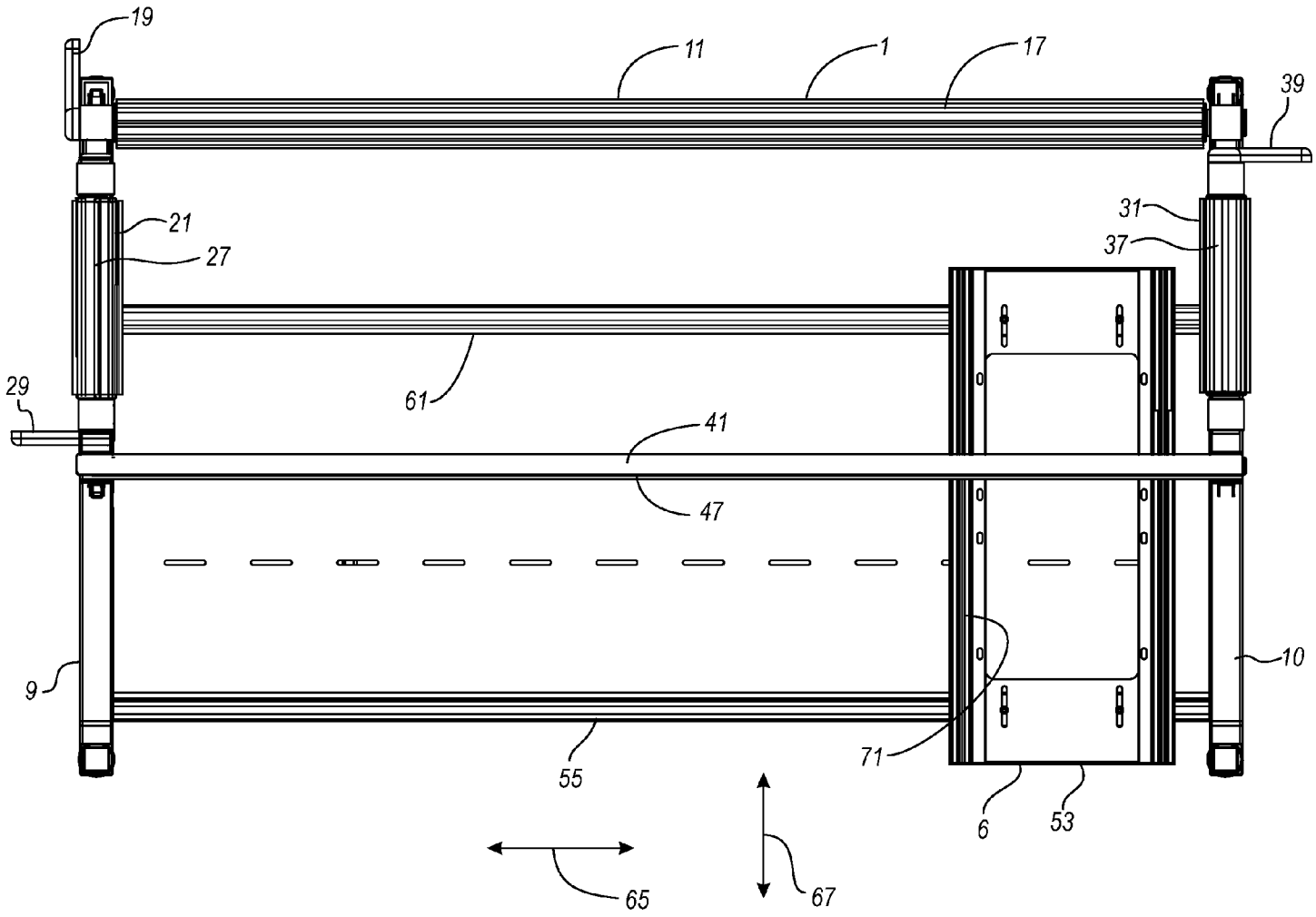
FIG. 2 is a plan view of a preferred embodiment of a hoop frame unit, including the frame support structure, hoop frame assembly, and machine carriage assembly, of the present invention.
Figure 3:
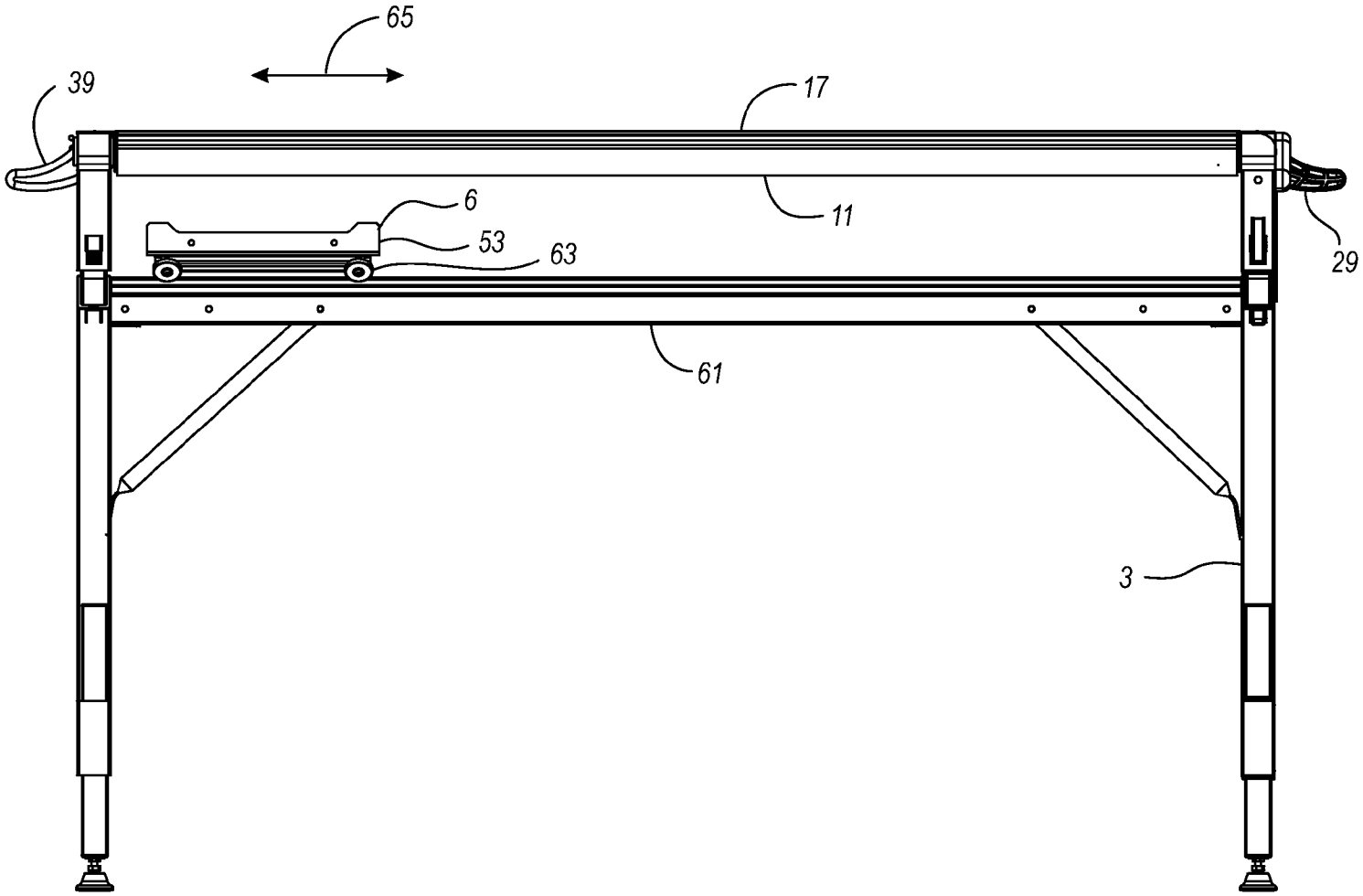
FIG. 3 is a front elevation view of a preferred embodiment of a hoop frame unit, including the frame support structure, hoop frame assembly, and machine carriage assembly, of the present invention.

Referring first to FIG. 1, a front perspective view of a preferred embodiment of a hoop frame unit 1 of the present invention is shown. For the embodiment shown, the hoop frame unit 1 is comprised of a frame support structure 3, a hoop frame assembly 5, and a machine carriage assembly 6. For the embodiment shown the frame support structure 3 is comprised of a first end support 7 which connects to a first frame end 9 and a second end support 8 which connects to a second frame end 10. Other variations and designs for the frame support structure 3 for supporting, stabilizing and positioning the frame assembly 5, and providing workable access to the frame assembly 5, will be known to persons ordinarily skilled in the art, in view of the disclosures of the specification and drawings presented. Various materials known to persons skilled in the art may be used for the frame support structure 3, as well as the other components of the hoop frame unit 1 and hoop frame assembly 5 of the present invention, which will provide the desired structural strength, durability, functionality, economy and appearance.

The hoop frame assembly 5, for embodiment shown, is comprised of a front fabric retainer 11, a rear fabric retainer 41, a first end retainer 21, and a second end retainer 31. The front fabric retainer 11 is secured to the first frame end member 9 by first front retainer support member 13 and is secured to the second frame end member 10 by a second front retainer support member 15. The first end fabric retainer 21 is affixed to the first frame end member 9 by first end retainer first support member 23 and a first end retainer second support member 25. Likewise the second end fabric retainer 31 is affixed to the second frame end member 10 by second end retainer first support member 33 and a second end retainer second support member 35. The rear fabric retainer 41 is affixed to the first frame end member 9 by first rear retainer support member 43 and is affixed to the second frame end member 10 by the second rear retainer support member 45. Other variations and designs for the hoop frame assembly 5, providing for variations in the connection of the hoop frame assembly components to the frame support structure 3 and for supporting, stabilizing and positioning the frame assembly 5, will be known to persons ordinarily skilled in the art, in view of the disclosures of the specification and drawings presented.

Figure 5:
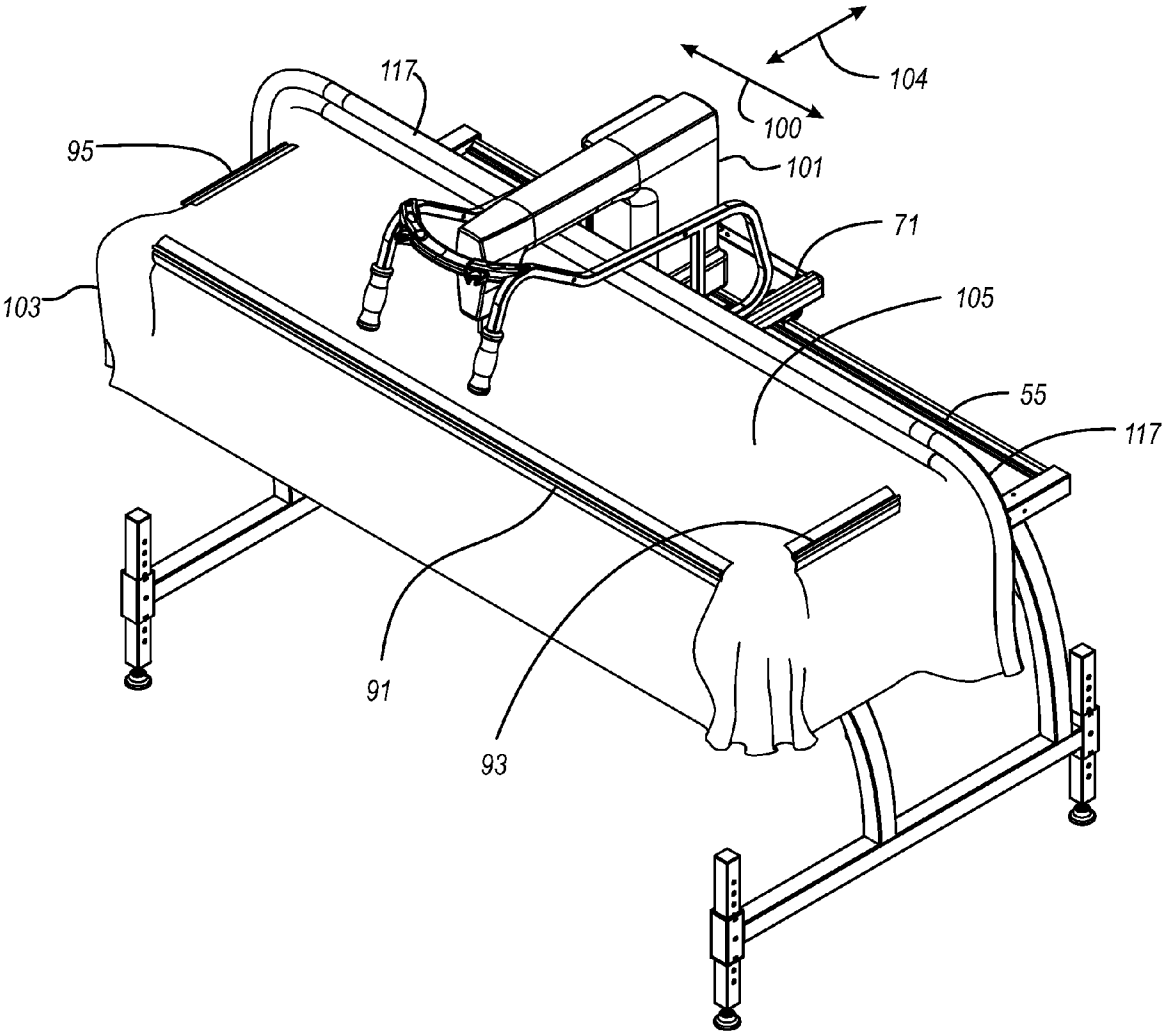
FIG. 5 is a front perspective view of a preferred embodiment of a hoop frame unit, including the frame support structure, hoop frame assembly, and machine carriage assembly, of the present invention with a quilt core in place on the hoop frame assembly and a fabric zone of the quilt core secured by fabric retainers and retainer clips of the hoop frame assembly, and with a quilting machine mounted on the machine carriage assembly.
Figure 6:
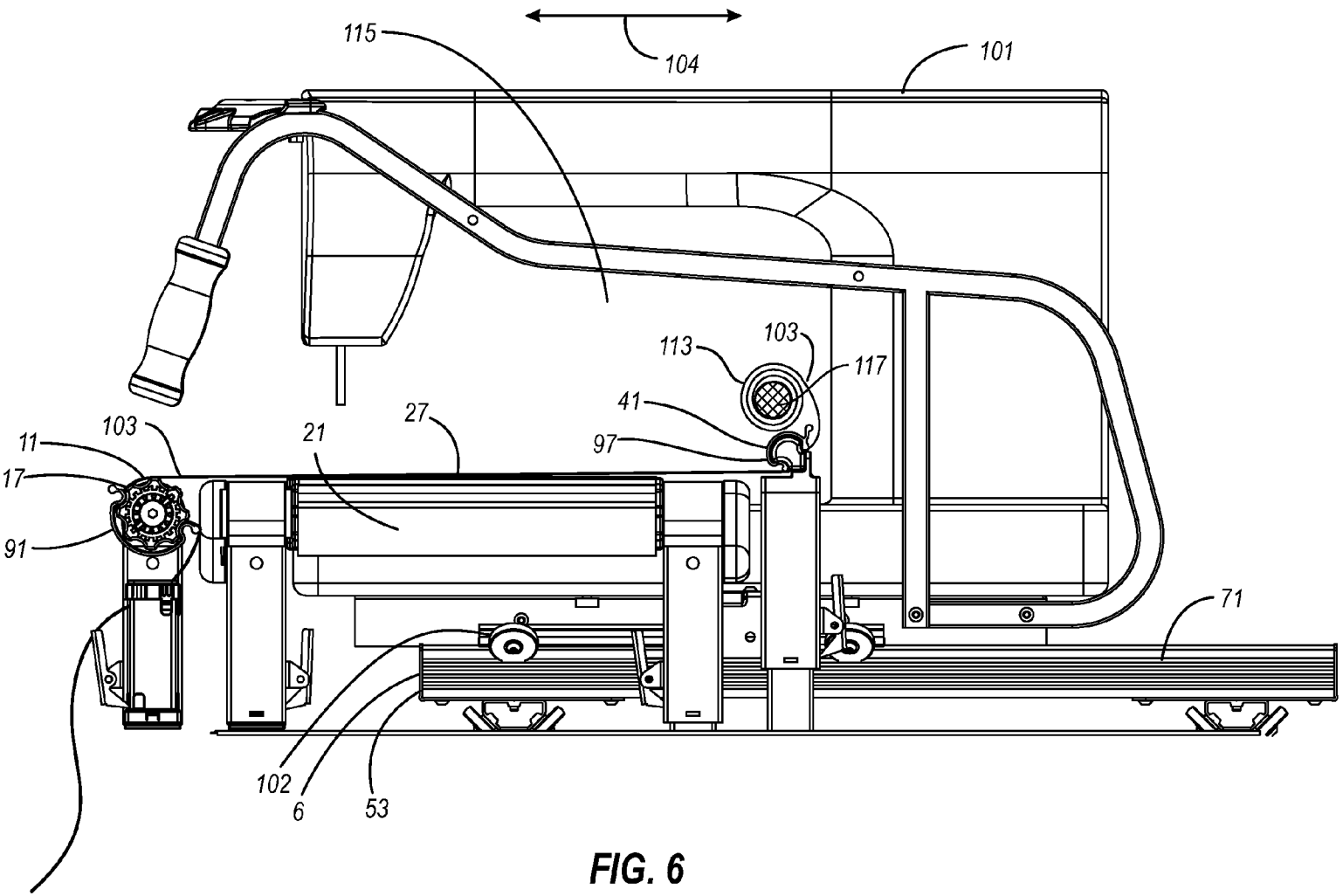
FIG. 6 is an end elevation view of a preferred embodiment of a hoop frame assembly of a hoop frame unit of the present invention with a quilt core in place on the hoop frame assembly and a fabric zone of the quilt core secured by fabric retainers and retainer clips of the hoop frame assembly, and with a quilting machine mounted on the machine carriage assembly.

The machine carriage assembly 6 is supported by a front carriage track 61 and a rear carriage track 55 which are affixed on opposing ends into the first frame end 9 and the second frame end 10. For the embodiment shown, front carriage rollers 63 and rear carriage rollers 57 provide for lateral carriage movement 65, and thus for the machine lateral movement 100 of a quilting machine 101 as shown in FIG. 5. The embodiment of the machine carriage assembly 6 shown in FIG. 1 incorporates a lateral carriage element 53 to which the carriage rollers 63, 57 are affixed, which provide for the machine carriage assembly 6 to accomplish carriage lateral movement 65, and a pair of longitudinal tracks 71, which for the embodiment shown in FIG. 1, provide for a quilting machine 101 with an integral wheeled base 102, as shown in FIG. 6 or a separate wheeled machine base to which a quilting machine may removably mounted, to provide for machine longitudinal movement 104 on the longitudinal tracks 71 on the carriage lateral element 53. Whether the quilting machine 101 itself or the quilting machine 101 mounted on a separate wheeled machine base, is positioned on the longitudinal tracks 71, the quilting machine is free rolling upon the lateral carriage element 53 thereby providing for machine longitudinal movement 104 concurrently with the carriage lateral movement 65 provided by the carriage lateral element 53. The machine carriage assembly 6, therefore provides for machine lateral movement 100 and machine longitudinal movement 104 as shown in FIG. 5 for a quilting machine 101 mounted on the machine carriage assembly 6.

Referring to FIGS. 1-6, the front fabric retainer 11 has a front retainer seat 17. The first end retainer 21 has a first end retainer seat 27 and the second end retainer 31 has a second end retainer seat 37. Referring now to FIGS. 5-6, a front retainer clip 91 may be used to secure fabric to the front fabric retainer 11 by mating with the front retainer seat 17 after the quilt core 103 is draped over the front fabric retainer 11. Likewise a first end retainer clip 93 and a second end retainer clip 95 may be used to mate respectively with the first end retainer seat 27 and the second end retainer seat 37 after the quilt core 103 is draped over the respective end retainers 21, 31 as shown in FIG. 5. In view of the disclosures of this specification and the drawings, alternative embodiments of the retainer seats and retainer clips for securing the fabric zones to the respective fabric retainers, other than that shown in the drawings of the present application, will be known to persons of skill in the art.

Figure 4:
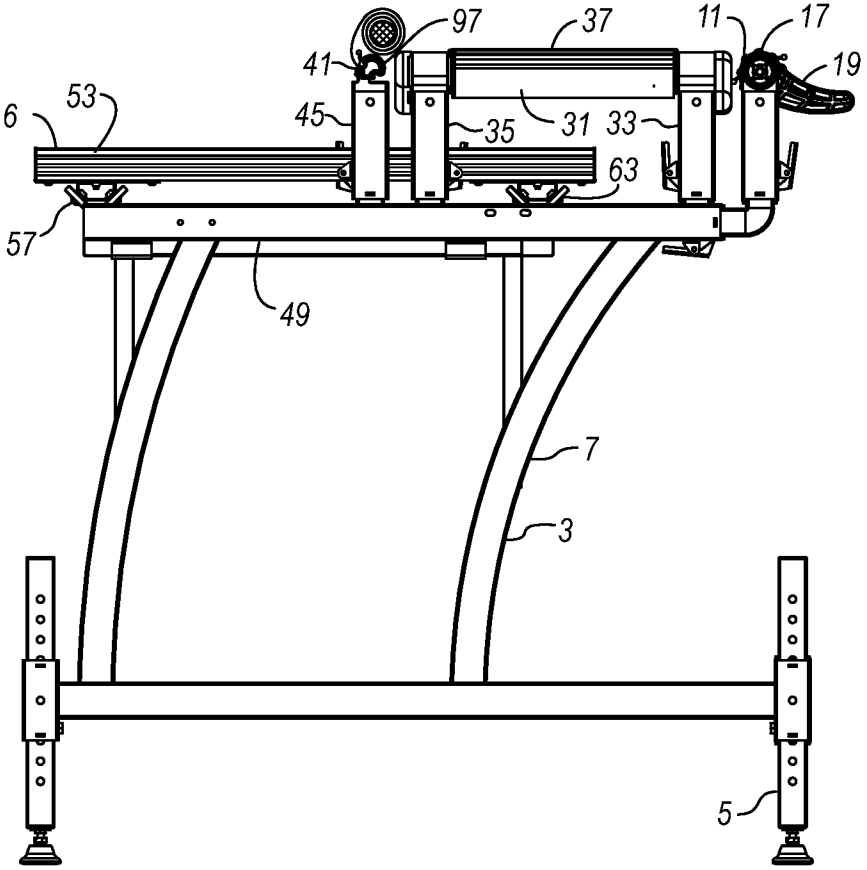
FIG. 4 is an end elevation view of a preferred embodiment of a hoop frame unit, including the frame support structure, hoop frame assembly, and machine carriage assembly, of the present invention.

Referring now to FIG. 4 and FIG. 6, the quilt core 103 may be secured to the rear fabric retainer 41 by draping the quilt core 103 over the rear fabric retainer 41, and securing the quilt core 103 in place by the rear retainer clip 97. The fabric loose end 113 of the quilt core 103 advanced into the machine throat 115 may be rolled onto a flexible take-up spool 117, as shown in FIG. 5 and FIG. 6, to help keep the fabric layers of the fabric loose end 113 from interfering with the sewing of the fabric zone 105. The fabric zone 105 is the portion of the quilt core 103 positioned between the front fabric retainer 11, the first end retainer 21, the second end retainer 31, and the rear fabric retainer 41, after the respective retainer clips 91, 93, 95 and 97, are secured in place for sewing as shown in FIG. 5. A front retainer tightening mechanism 19, first end retainer tightening mechanism 29 and second end retainer tightening mechanism 39 may be used to further tighten the fabric zone 105 as desired for sewing by the quilting machine 101. For preferred embodiments, the front retainer tightening mechanism 19, the first end retainer tightening mechanism 29, and the second end retainer tightening mechanism 39 may have a ratchet drive, and may have optional handles.

When the quilt core 103 is secured and the selected fabric zone 105 is in place as shown in FIG. 5, the quilting machine 101 may be operated by the user to sew the desired quilting pattern in the fabric zone 105. Once the sewing of the fabric zone 105 is completed, the retainer clips, 91, 93, 95 and 97 may be removed from the quilt core 103 and the fabric moved and then re-secured, presenting another selected fabric zone 105 for sewing by the user. The hoop frame unit 1 and the hoop frame assembly 5 of the present invention provide for complete flexibility in the sequencing of the sewing of the respective fabric zones 105. A typical quilting frame requires that the quilt be sewed from front to back, or vice versa, with the fabric progressively being fed onto a take-up rail as each strip of the quilt core is sewed from one side of the quilt core to the other. The hoop frame unit 1 and the hoop frame assembly 5 of the present invention, on the other hand, provide for the quilt core to be re-positioned laterally, longitudinally or diagonally, or to be rotated to any extent desired by the user. When sewing is completed on a fabric zone 105, the user has complete flexibility to re-position the quilt core as desired for the convenience or preference of the user as the user progresses from one fabric zone 105 to another. The user can sequence the sewing of the fabric zones as desired and can overlap respective fabric zones 105 on any side, in any direction, and to any extent desired.

Figure 7:
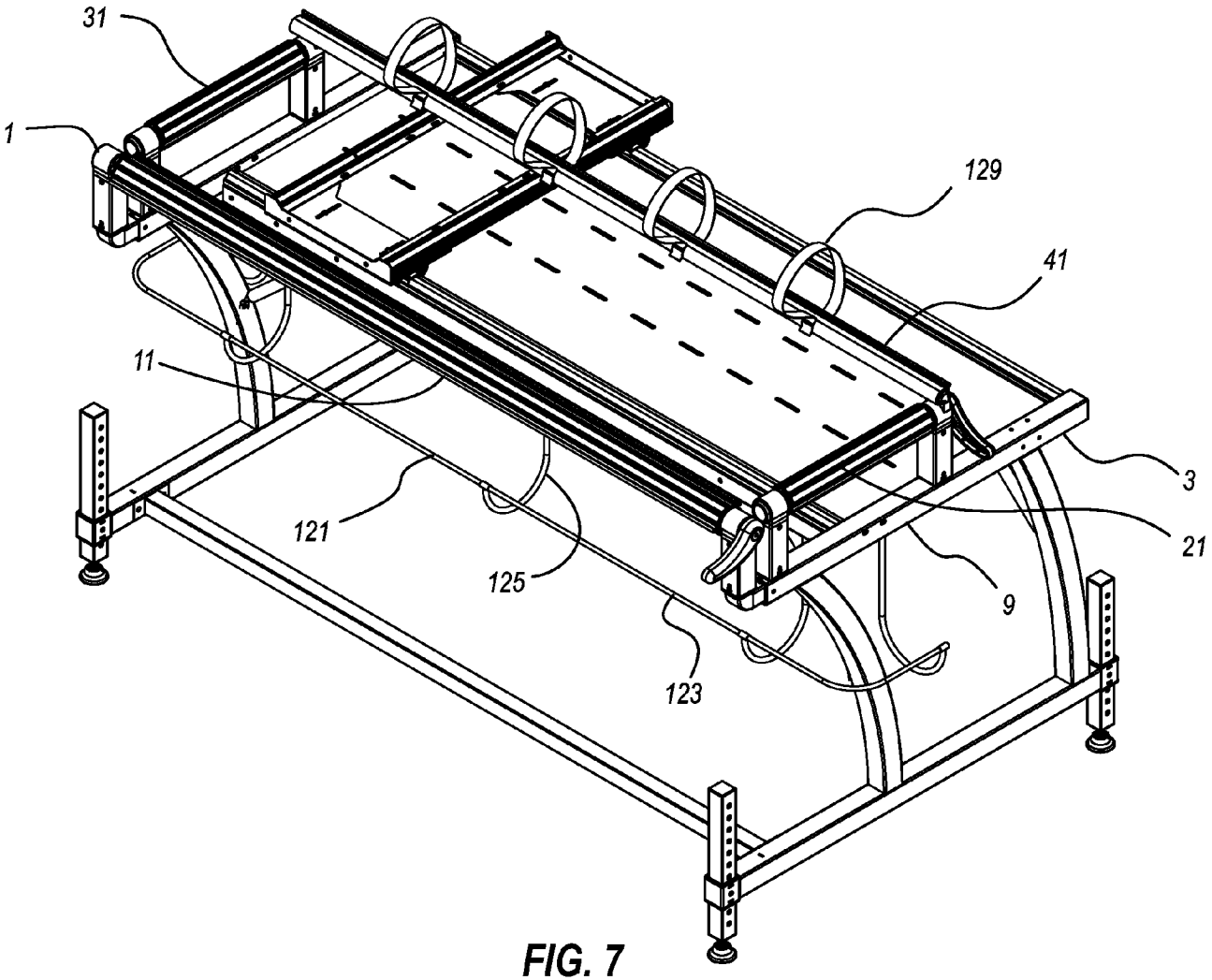
FIG. 7 is a front perspective view of a preferred embodiment of a hoop frame unit of the present invention with a fabric free end holder and rear retainer straps.
Figure 8:
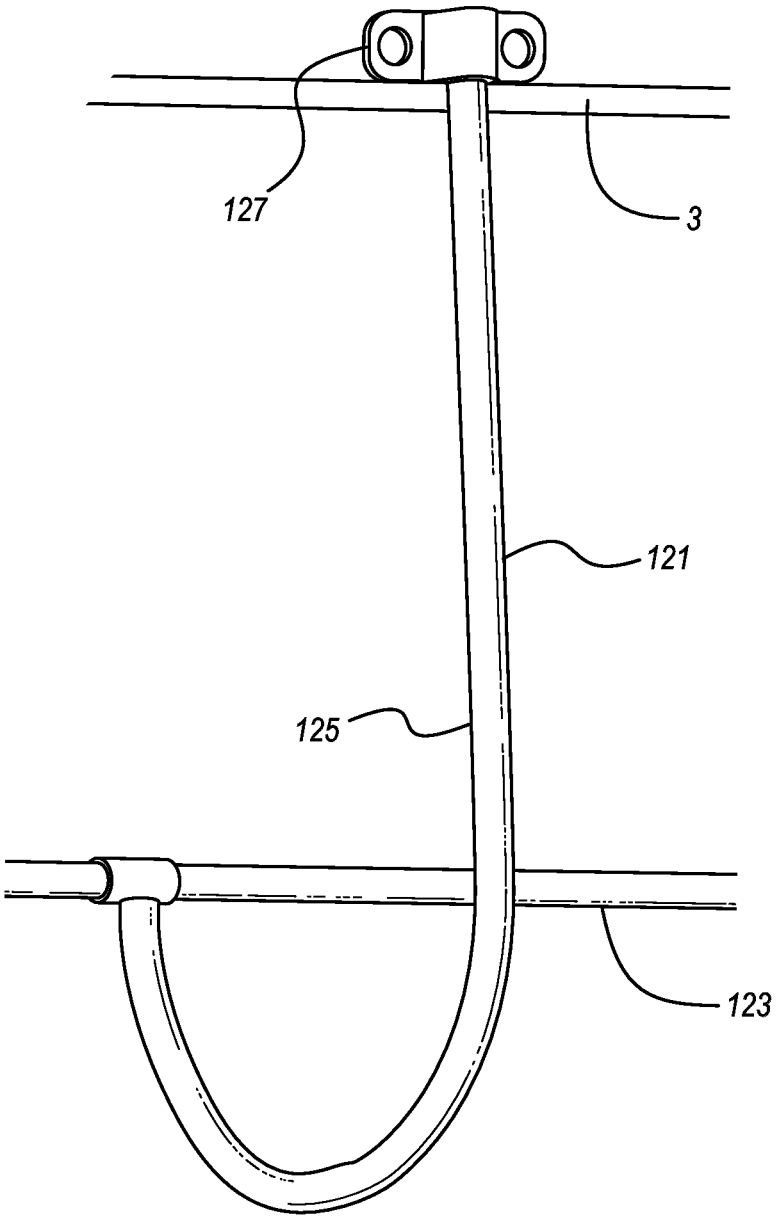
FIG. 8 is a vertical view of a detail of a preferred embodiment of a fabric free end holder of the present invention.

Referring now to FIG. 7, an optional feature of the present invention may be a fabric free end holder 121, which may be used for stashing the ends of the portions of the quilt core 103 which drape over the front fabric retainer 11, the first end retainer 21, and the second end retainer 31, as shown in FIG. 5, providing for those portions of the quilt core 103 to be held off the floor and out of the way of the user as the user engages in positioning, securing and sewing a fabric zone 105. For the embodiment shown, the fabric free end holder 21 may comprise a horizontal holder member 123, a plurality of vertical holder members 125, and a plurality of frame brackets 127 which connect each of the vertical holder members 125 to the frame support structure 3 as shown in FIG. 8. For the preferred embodiment shown in FIG. 7, the fabric free end holder 121 may extend across the front of the hoop frame unit 1 below the front fabric retainer 11, and around at least a portion of each end of the hoop frame unit 1 below the first end retainer 21 and the second end retainer 31.

Referring again to FIG. 7, another optional feature may be a plurality of rear retainer straps 129 which are attached to the rear fabric retainer 41, each of the rear retainer straps 129 having an attachable end which allows each rear retainer strap 129 to be secured over the fabric loose end 113 of the quilt core 103 advanced into the machine throat 115, which may be rolled onto a flexible take-up spool 117, as shown in FIG. 5 and FIG. 6, further helping to keep the fabric layers of the fabric loose end 113 from interfering with the sewing of the fabric zone 105.

Another optional feature of the present invention may be a quilt machine controller with pattern matching software which would allow the end points of the sewing of the pattern of a fabric zone 105 to be matched with the start points for the continued sewing of the pattern in the subsequent fabric zone 105 secured in place by the user using the hoop frame assembly 5 of the present invention.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A hoop frame unit for use in machine quilting of a quilt core using a quilting machine, the hoop frame unit having a quilt core positioning capability for sequential positioning and securing of sequential fabric zones of the quilt core for sewing, the hoop frame unit comprising:

a frame support structure;

a hoop frame assembly comprising a front fabric retainer, a rear fabric retainer, a first end retainer, and a second end retainer, the front fabric retainer, the rear fabric retainer, the first end retainer, and the second end retainer each being affixed to the frame support structure, the front fabric retainer having a front retainer seat and a front retainer clip, the rear fabric retainer having a rear retainer seat and a rear retainer clip, the first end retainer having a first end retainer seat and a first end retainer clip, and the second end retainer having a second end retainer seat and a second end retainer clip, the front fabric retainer, the rear fabric retainer, the first end retainer and the second end retainer each having an overlapping capability for overlapping of the quilt core for positioning and securing a selected fabric zone for sewing; and a machine carriage assembly mounted on the frame support structure, the machine carriage assembly providing for lateral and longitudinal movement of the quilting machine.

2. The hoop frame unit recited in claim 1 wherein one or more of the front fabric retainer, the first end retainer, and the second end retainer have a fabric tightening mechanism.

3. The hoop frame unit recited in claim 2 wherein each fabric tightening mechanism has a ratchet drive.

4. The hoop frame unit recited in claim 1 wherein the machine carriage assembly comprises a front carriage track, a rear carriage track, a lateral carriage element, and a pair of longitudinal tracks on the lateral carriage element.

5. A hoop frame assembly for use in machine quilting of a quilt core using a quilting machine, the hoop frame assembly having a quilt core positioning capability for sequential positioning and securing of sequential fabric zones of the quilt core for sewing, the hoop frame assembly comprising a front fabric retainer, a rear fabric retainer, a first end retainer, and a second end retainer, the front fabric retainer, the rear fabric retainer, the first end retainer, and the second end retainer each being affixed to a support structure, the front fabric retainer having a front retainer seat and a front retainer clip, the rear fabric retainer having a rear retainer seat and a rear retainer clip, the first end retainer having a first end retainer seat and a first end retainer clip, and the second end retainer having a second end retainer seat and a second end retainer clip, the front fabric retainer, the rear fabric retainer, the first end retainer and the second end retainer each having an overlapping capability for overlapping of the quilt core for positioning and securing a selected fabric zone for sewing.

6. The hoop frame assembly recited in claim 5 wherein one or more of the front fabric retainer, the first end retainer, and the second end retainer have a fabric tightening mechanism.

7. The hoop frame assembly recited in claim 6 wherein each fabric tightening mechanism has a ratchet drive.

8. The hoop frame assembly recited in claim 5 further comprising a machine carriage assembly which comprises a front carriage track, a rear carriage track, a lateral carriage element, and a pair of longitudinal tracks on the lateral carriage element.

9. A method for sewing by a user, with a quilting machine, of a quilt core comprised of one or more fabric layers, using a hoop frame unit and without the use of a full width quilting frame, the hoop frame unit having a quilt core positioning capability for sequential positioning and securing of sequential fabric zones of the quilt core for sewing, the method comprising:

mounting the quilting machine on a machine carriage assembly, the machine carriage assembly being supported by a frame support structure;

sequentially securing respective fabric zones of the quilt core in a hoop frame assembly, the hoop frame assembly being supported by and positioned by the frame support structure, the hoop frame assembly comprising a front fabric retainer, a rear fabric retainer, a first end retainer, a second end retainer, the front fabric retainer having a front retainer seat and a front retainer clip, the rear fabric retainer having a rear retainer seat and a rear retainer clip, the first end retainer having a first end retainer seat and a first end retainer clip, and the second end retainer having a second end retainer seat and a second end retainer clip, the front fabric retainer, the rear fabric retainer, the first end retainer and the second end retainer each having an overlapping capability for overlapping of the quilt core for positioning and securing a selected fabric zone for sewing; and sewing respective pattern segments in each fabric zone sequentially, the machine carriage assembly providing for the quilting machine to be moved laterally and longitudinally by the user for sewing the pattern segments.

10. The method recited in claim 9 wherein one or more of the front fabric retainer, the first end retainer, and the second end retainer have a fabric tightening mechanism, and the respective fabric zone is tightened by the one or more fabric tightening mechanisms.

11. The method recited in claim 9 wherein one or more of the front fabric retainer, the rear fabric retainer, and the first end retainer have a fabric tightening mechanism with a ratchet drive, and the respective fabric zone is tightened by the one or more fabric tightening mechanisms.

12. The method recited in claim 9 wherein the machine carriage assembly comprises a front carriage track, a rear carriage track, a lateral carriage element, and a pair of longitudinal tracks on the lateral carriage element.

13. The method recited in claim 9 wherein each respective fabric zone is secured to the front fabric retainer, the rear fabric retainer, the first end retainer, and the second end retainer respectively by respective retainer clips.

14. The method recited in claim 9 wherein each respective fabric zone is secured to the front fabric retainer by the front retainer clip, to the rear fabric retainer by the rear retainer clip, to the first end retainer by the first end retainer clip, and to the second end retainer by the second end retainer clip.

* * * * *